US007693296B2

(12) United States Patent
Monitto et al.

(10) Patent No.: US 7,693,296 B2
(45) Date of Patent: Apr. 6, 2010

(54) LOUDSPEAKER RIGGING SYSTEM HAVING CONTAINED MANEUVERABLE CONNECTING LINKS

(75) Inventors: John Monitto, San Rafael, CA (US); John McGhee, Parkdale, OR (US); Dean Marshall, San Rafael, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 1035 days.

(21) Appl. No.: 11/400,747

(22) Filed: Apr. 6, 2006

(65) Prior Publication Data

US 2006/0210095 A1 Sep. 21, 2006

Related U.S. Application Data

(63) Continuation-in-part of application No. 11/035,676, filed on Jan. 13, 2005.

(60) Provisional application No. 60/669,176, filed on Apr. 6, 2005, provisional application No. 60/536,429, filed on Jan. 13, 2004, provisional application No. 60/548,364, filed on Feb. 27, 2004.

(51) Int. Cl.
*H04R 25/00* (2006.01)

(52) U.S. Cl. ..... 381/386; 381/87; 381/334

(58) Field of Classification Search ..... 381/87, 381/300, 304, 305, 332, 334, 335, 336, 182, 381/186, 386; 181/144, 145, 150, 199; 248/284.1, 248/323, 324
See application file for complete search history.

(56) References Cited

U.S. PATENT DOCUMENTS 4,101,109 A 7/1978 Edwards
4,660,728 A 4/1987 Martin
5,000,286 A 3/1991 Crawford et al.
5,266,751 A 11/1993 Taguchi
5,620,272 A 4/1997 Sheng
5,758,852 A 6/1998 Martin
5,816,545 A 10/1998 Malizin (Continued)

*Primary Examiner*—Huyen D Le
(74) *Attorney, Agent, or Firm*—Donald L. Beeson; Beeson Skinner Beverly

(57) ABSTRACT

A side frame for a loudspeaker rigging system has a frame structure mountable to the side of a loudspeaker, and links associated with the frame structure for linking together the corners of the frame structures of vertically adjacent side frames. The links associated with each side frame structure include a pivot link and splay adjustment link, each of which has a top extended end and a base end. Stow channels, which are preferably located in the bottom corner regions of the frame structure, contain the pivot link and splay adjustment link in the frame structure. A gripping structure associated with at least one, and preferably each link of the pivot and splay adjustment links allows a user to easily maneuver a link from its stowed to its deployed position. The extended end of the splay adjustment link includes at least two, and preferably an array of pin holes which can selectively be matched with one pin hole within a row of pin holes in a bottom corner region of the side frame to permit adjustments of the splay angle over a range of angles. Suitably, two rows of pin holes are provided in the top extended end of the splay adjustment link to permit multiple and incrementally small splay angle adjustments.

In the preferred embodiment, the frame structure is comprised of an assembly of parts comprised of a center core structure sandwiched between two side plates.

21 Claims, 11 Drawing Sheets

U.S. PATENT DOCUMENTS

| | | | | |
|---|---|---|---|---|
| 5,819,959 | A | 10/1998 | Martin | |
| 5,996,728 | A | 12/1999 | Stark | |
| 6,009,182 | A | 12/1999 | Gunness | |
| 6,536,554 | B2 | 3/2003 | Andrews et al. | |
| 6,640,924 | B2 | 11/2003 | Messner | |
| 6,652,046 | B2 | 11/2003 | Christner | |
| 7,201,251 | B1 * | 4/2007 | Baird | 181/145 |
| 7,298,860 | B2 * | 11/2007 | Engebretson et al. | 381/386 |
| 7,328,769 | B1 * | 2/2008 | Adamson | 181/199 |

* cited by examiner

LOUDSPEAKER RIGGING SYSTEM HAVING CONTAINED MANEUVERABLE CONNECTING LINKS

CROSS-REFERENCE TO RELATED APPLICATIONS

This application claims the benefit of U.S. Provisional Application No. 60/669,176, filed Apr. 6, 2005, and is a continuation-in-part of U.S. application Ser. No. 11/035,676 filed Jan. 13, 2005, now pending, which claims the benefit of U.S. Provisional Application No. 60/536,429 filed Jan. 13, 2004, and U.S. Provisional Application No. 60/548,364 filed Feb. 27, 2004.

BACKGROUND

The present invention relates to loudspeaker rigging systems and more particularly to rigging hardware for suspending a stacked array of loudspeakers of a sound reinforcement system at a predetermined location relative to an audience. The present invention has particular application in rigging a stacked array of loudspeakers wherein a vertical splay between loudspeakers is desired to achieve a desired coverage and acoustic performance.

Sound systems for large venues typically involve the suspension or "flying" of stacks of loudspeakers in vertical arrays to achieve a desired acoustic output and coverage for a large audience. Such vertical stacks of loudspeakers are typically suspended and held together by rigging systems which may be attached to rigging hoists which position the stack at a desired elevation and location, typically above or in the vicinity of a performance stage. A flown stack of loudspeakers can include many speaker boxes and the rigging system for flying the stack must be strong enough to support the weight of the large stack. Such rigging systems generally involve the use of metal frame elements secured to the speaker boxes that can be used to link the speakers together in a stacked arrangement and to lift the stack to an overhead flying position.

Typically, the individual speaker boxes of a vertical stack of loudspeakers held by a rigging system will have to be adjusted to meet the requirements of a particular application. Setting the proper angle between speakers, or "splay angle," can be critical to achieving desired acoustic performance and minimizing interference between the acoustic output between speakers in the stack. Splay angles are adjusted by adjusting the linkages between the rigging frames of the stacked speakers to create a desired angle. One such adjustment method is disclosed in U.S. Pat. No. 6,640,924 issued Nov. 4, 2003 to Ian Messner (the "Messner patent"). The Messner patent discloses a rigging system wherein the splay angle is adjusted by a cam plate that pivotally extends down from the bottom front end of the side frame of one loudspeaker to engage the top front end of the side frame of the loudspeaker directly below. To set the splay angle, the cam plate must be manipulated into a cam plate receiving channel in the top of the underneath side frame and pinned when the desired cam hole is aligned with the pin hole in the under frame. This process turns out to be relatively difficult and leads to misses in the hole alignment while assembling the array. The number of pinning locations is also relatively limited.

Another problems associated with rigging systems involves the difficulty of maneuvering the links in the rigging frame's stow channel while rigging or breaking down a system. The installer must physically grab onto the links to slide them in and out the stow channels, creating a risk of injury to the installers fingers. Links which are not pinned into place can also fall to the ground if they are dropped.

There is a need for a rigging system for loudspeakers having links the are easily maneuvered in the rigging frame and that will can not drop out of the frame. There is also a need to provide in such a rigging system a system that is relatively easy to assemble and that has small incremental splay angle adjustment capabilities.

SUMMARY OF THE INVENTION

Briefly, the present invention involves a new rigging side frame for a loudspeaker rigging system comprised of a frame structure having two top corner regions and two bottom corner regions. A pivot link and a splay adjustment link are associated with the side frame for connecting the side frame with a side frame of a vertically adjacent loudspeaker in a stack of loudspeakers. Each of these links has a base end, a top extended end and locking pin holes at each end for pinning the links to the side frames, and each is stowed in a stow channel in the corner regions of the frame. At least one hand accessible gripping structure, suitably having gripping knob, is provided on at least one and preferably both of the links such that the gripping member can be gripped by a rigger of a loudspeaker system to move the link up and down within its stow channel between a stowed position and a deployed position. Preferably these gripping members extend through guide slots in the rigging frame structure so as to contain the links in the frame structure.

In another aspect of the invention, at least one guide channel is provided in one of the top or bottom corner regions of the frame structure for receiving the base end of one of deployed links of an adjacent side frame. This guide channel has side walls and locking pin holes through the side walls which are positioned to align with the pin hole of the link of an adjacent frame structure that is inserted into and seated within the guide channel. Preferably, there is a correspondence in the shape of the guide channel and the base end of the deployed link seated within the channel such that the locking pin holes in the guide channel and the base end of the link will readily align when the base of the link is dropped into the guide channel. Preferably, two cradling guide channels are provided, preferably in the two top corner regions of the frame, for receiving correspondingly-shaped base ends of both the pivot link and the adjustment link of an adjacent rigging side frame, such that, when the end of both links are moved into the guide channels, the locking pin holes in both links and the guide channels self-align.

In another aspect of the invention, the extended end of the splay adjustment link is provided with at least two and preferably an array of selectable pin holes at different incremental distances from the locking pin hole at the base of the link. At least one pin hole and preferably a row or array of pin holes are provided in a corner region of the frame structure bounding the splay adjustment link stow channel, such that, when the gripping knob for the splay adjustment link is moved to move the splay adjustment link its stow channel, a selected one of the pin holes in the adjustment link can be aligned to the corresponding pin hole in the frame structure to set the vertical splay angle of the side frame relative to the rigging side frame of a vertically adjacent loudspeaker. By providing an array of pin holes in the extended end of the splay adjustment link which match up with a plurality of pin holes in the adjustment link stow channel, multiple of selectable splay angles can be achieved by selecting which of the adjustment link pin holes will be matched to which of the pin holes of the stow channel before pinning the adjustment link.

In still a further aspect of the invention, the side frame is a frame assembly which includes a center core which having guide channel cutouts and stow channel openings. Front and back side plates affixed to either side of the center core structure extend over these cutouts and openings and provide the side walls for the guide channels and stow channels. At least one gripping knob is provided that having an attachment end that attaches to at least one of the links for moving the link within its stow channel. Suitably, the front plate of the assembly has a vertical guide slot in adjacent the stow channel for accommodating the attachment end of the gripping knob. Preferably the attachment end of the gripping knob is long enough to extend through the back plate of the frame assembly, which also preferably has a guide slot opposing the slot in the front plate for accommodating the tip the knob's attachment end. The frame assembly is relatively easy to fabricate and assemble as compared to conventional rigging assemblies.

DETAILED DESCRIPTION OF THE ILLUSTRATED EMBODIMENT

Figure 1:
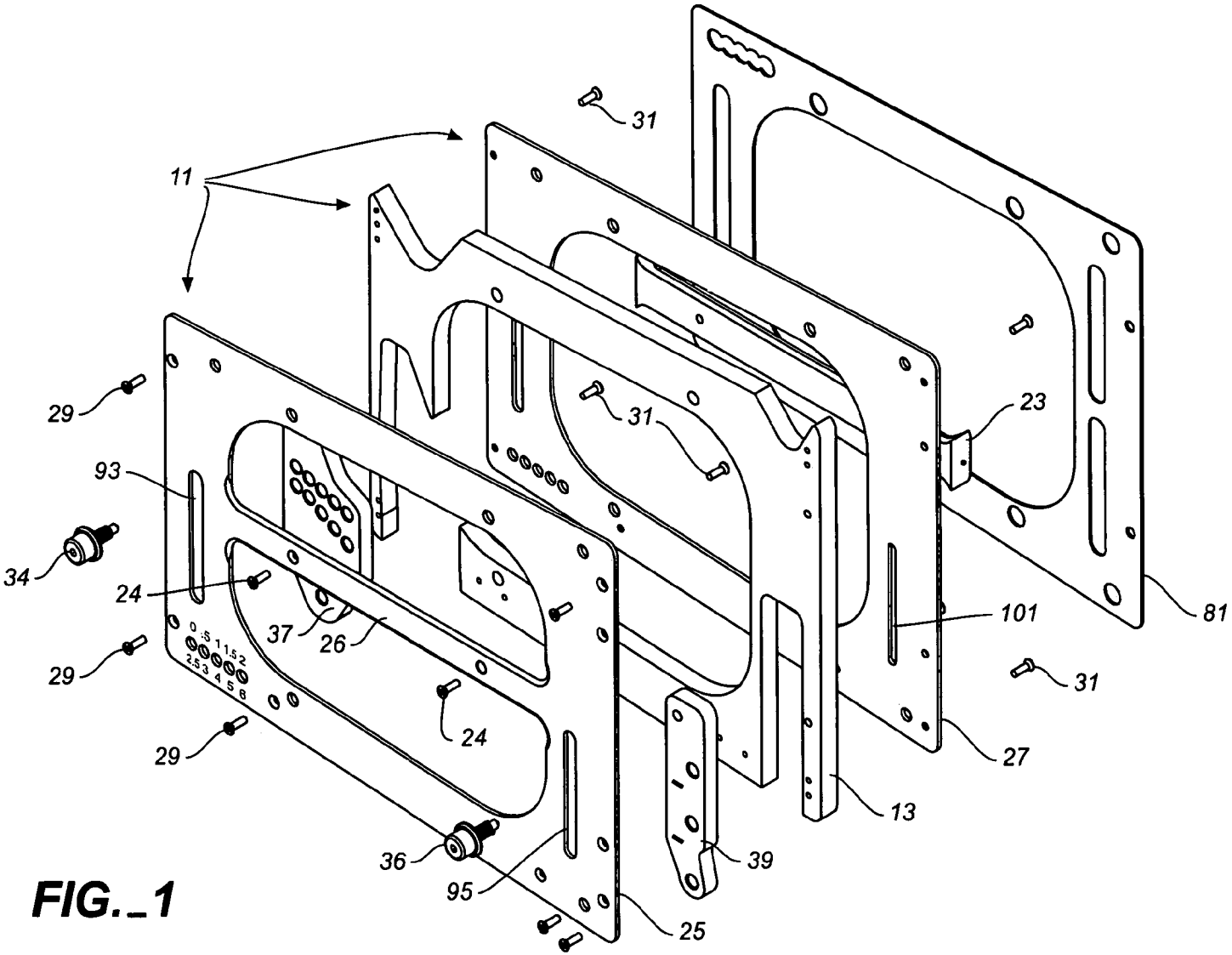
FIG. 1 is an exploded view of a frame assembly for the rectilinear frame structure of a speaker rigging side frame in accordance with the invention with guide slots and gripping structuress for maneuvering the links of the frame assembly.
Figure 1A:
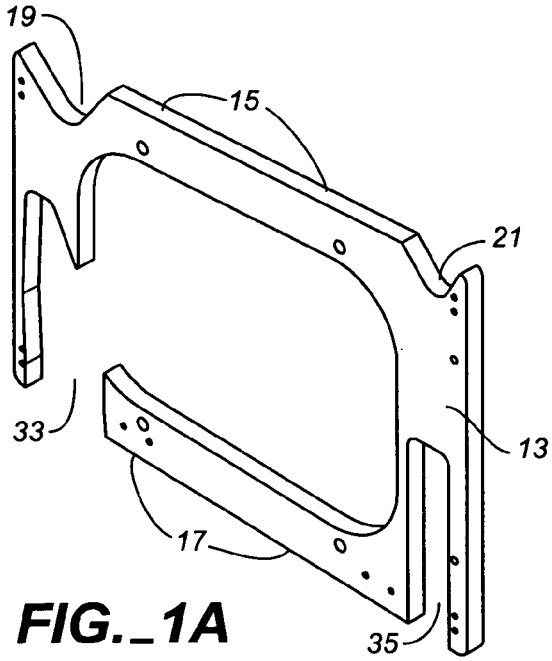
FIG. 1A is an perspective view of the center core of the rigging side frame of the invention.
Figure 1B:
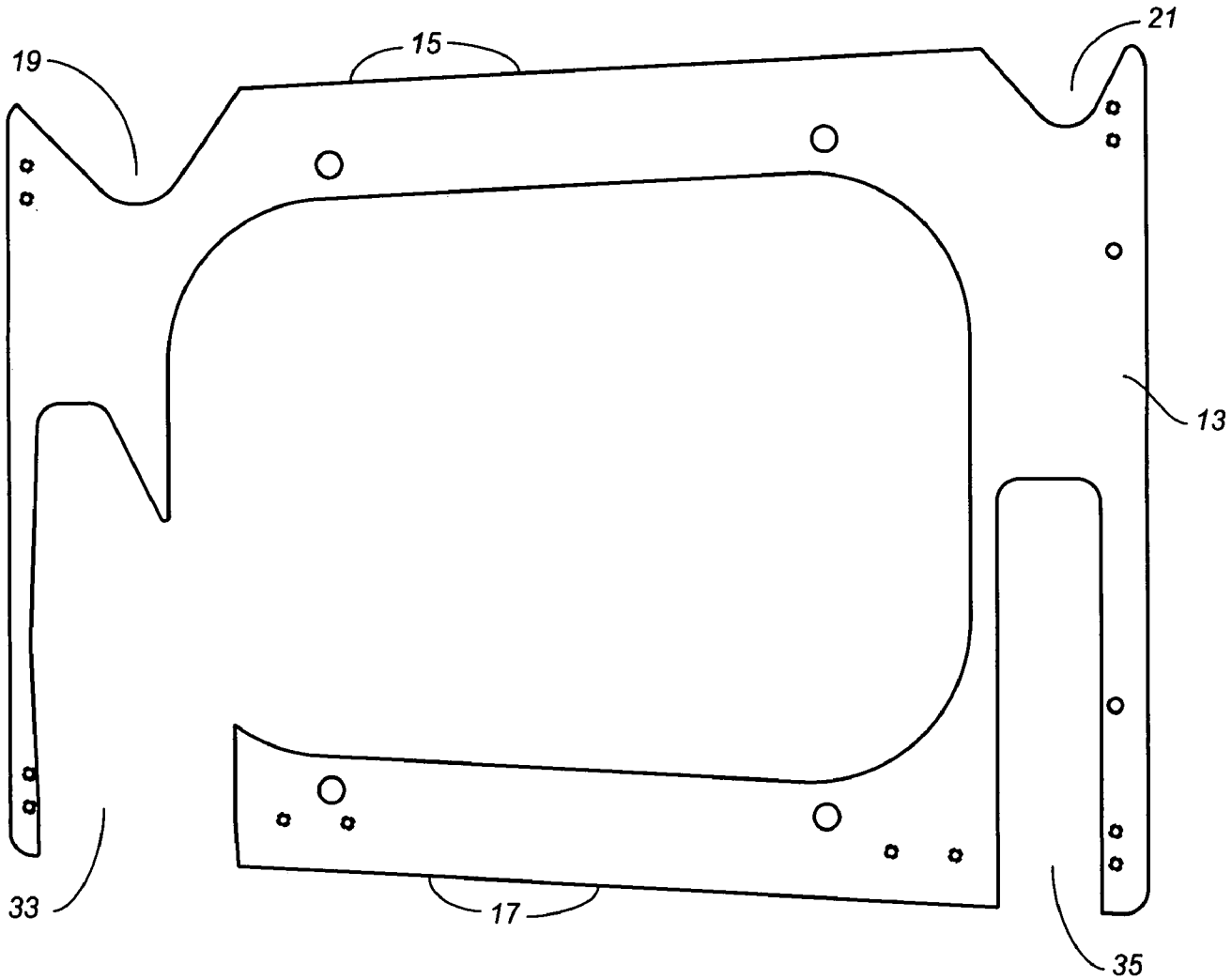
FIG. 1B side elevational view of the center core of the frame assembly shown in FIG. 1.

The preferred assembly construction of the rigging side frame of the invention is disclosed in FIGS. 1, 1A, and 1B. The rigging side frame is comprised of a frame assembly denoted by the numeral 11 having a center core 13 with an top edge portion 15. As best shown in FIGS. 1A and 1B, the top edge portion of the center core includes two cutouts 19, 21, which form seating surfaces 63, 75 for link guide channels of the assembled frame as hereinafter described. The center core of the assembly is sandwiched between front and back side plates 25, 27 that are secured to the center core sections by suitable front and back attachment screws 29, 31. As later described, when assembled, the open regions 33, 35 in the core's bottom edge portion 17, form additional guide channels 33*a* and 35*a* for stowing frame connecting links associated with the side frame, namely, splay adjustment link 37 and pivot link 39. A gripping knob 34, 36 associated with each connecting link is provided for maneuvering the links in their respective guide channels as also later described.

With further reference to FIG. 1, the frame assembly is seen to further include a cross-bar 26, which serves as a handle or stepping rail usually found on conventional rigging frames. Backing bar 23 is provided to give this handle additional structural support. The backing bar can be attached to the back of the handle by suitable screw attachments 24.

In addition to the frame assembly 11, FIG. 1 shows a gasket 81 conforming to the shape and configuration of the assembled frame. This gasket is suitably a rubber gasket and can be used behind the frame when the frame is mounted to the side of a loudspeaker. The back side of the gasket will suitably be provided with an adhesive material to hold the gasket to the loudspeaker when the frame is being mounted.

It will be understood that the center core 13 of frame assembly 11 could be divided into sections instead of being in one piece as shown. It will also be understood that certain aspects of the invention described below involving the connecting link and the adjustment of the connecting links could be achieved with a unitary frame structure that is not an assembly of parts.

Figure 2:
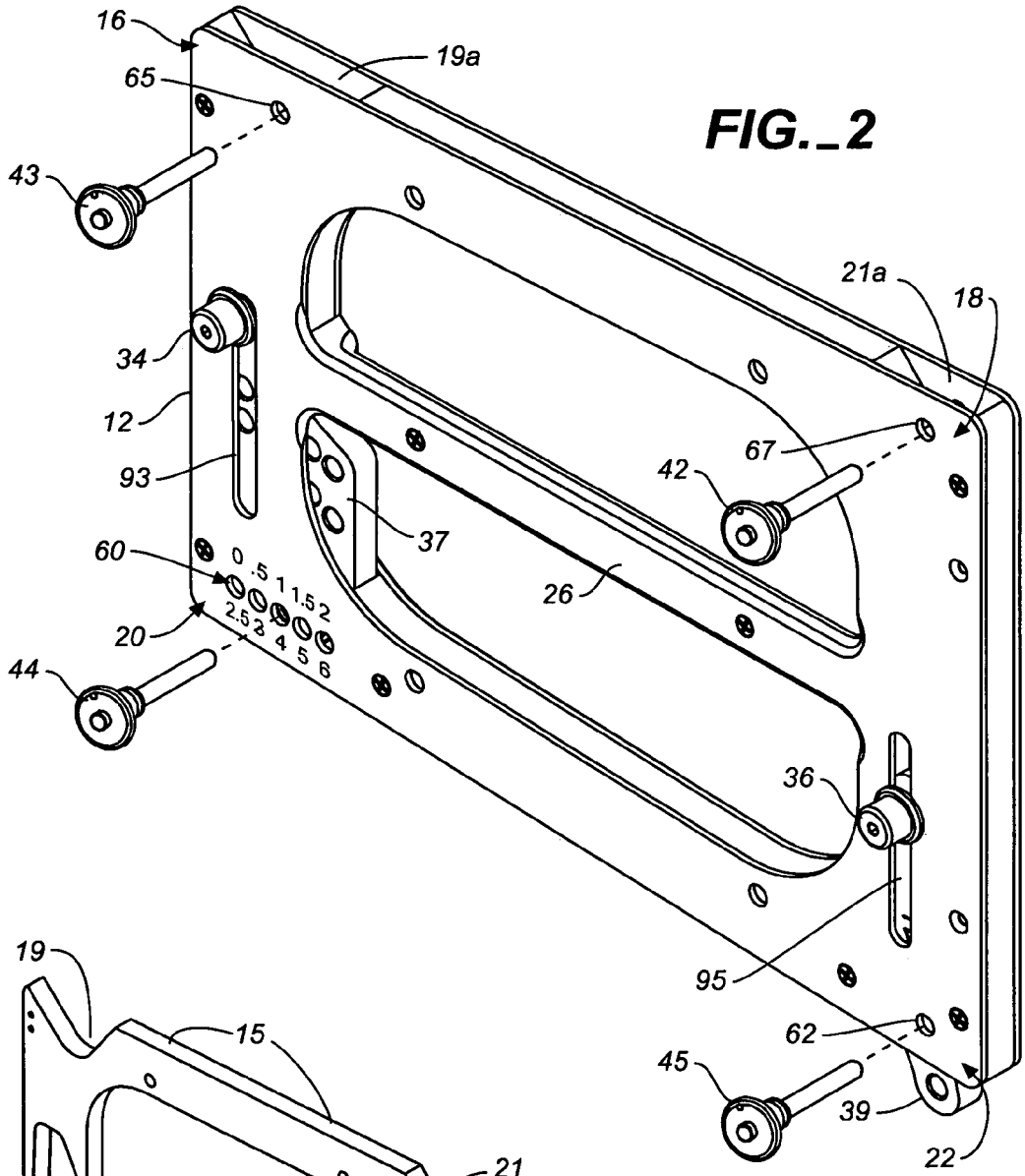
FIG. 2 is an perspective view of the rigging side frame of the invention showing the assembled frame structure.

FIG. 2 shows the frame assembly 11 in FIG. 1 assembled into a frame structure 12, with its associated frame connecting links 37, 39. FIG. 2 additionally shows top locking pins 42, 43, and bottom locking pins 44, 45, used for pinning the connecting links in their operative and stowed positions. It is seen that the assembled frame structure has a generally rectangular shape—in the illustrated embodiment its slightly trapezoidal—with top corner regions 16, 18, and bottom corner regions 20, 22, which receive the connecting links as described below, and which are linked to the corner regions of side frames of vertically adjacent loudspeakers. The locking pins are used to pin these links in place as later described by means of the role of pin holes 60 and pin hole 62 located in the bottom corner regions of the frame near the frames bottom edge 66, and by the pin holes 65, 67 located in the top corner regions of the frame. Suitably these pins will be commercially available quick release pins.

FIG. 2 additionally shows the gripping knobs 34, 36, which attach to the frames associated connecting links and which extend from the front plate 25 of the frame structure so that they can be gripped by a rigger of a loudspeaker system. More specifically, gripping knob 34 is attached to the splay adjustment link 37 through a vertical guide slot 93 formed in the front plate adjacent the splay adjustment link, while gripping knob 36 is attached to pivot link 39 through a vertical guide slot 95 formed in the opposite side of the front plate adjacent the pivot link. By gripping the extending knobs, a rigger is able to move the links 35, 37 up or down to the full extent of the slots 93, 95 without having to grab onto the links themselves. This will reduce the risk that the riggers hand can be pinched between a link and structure of the rigging frame. Also, because they are contained by the slots, the knobs will contain the connecting links in their respective guide channels and prevent them from falling out of the channels.

Figure 6:
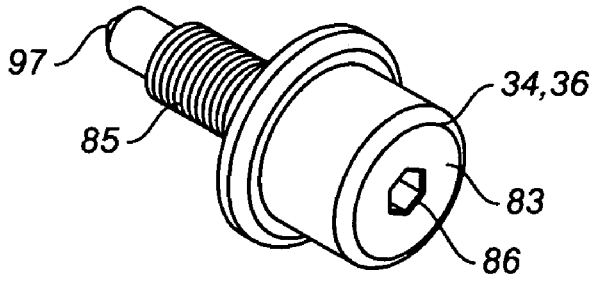
FIG. 6 a perspective view of a gripping post used to maneuver the links in the stow channels.
Figure 7:
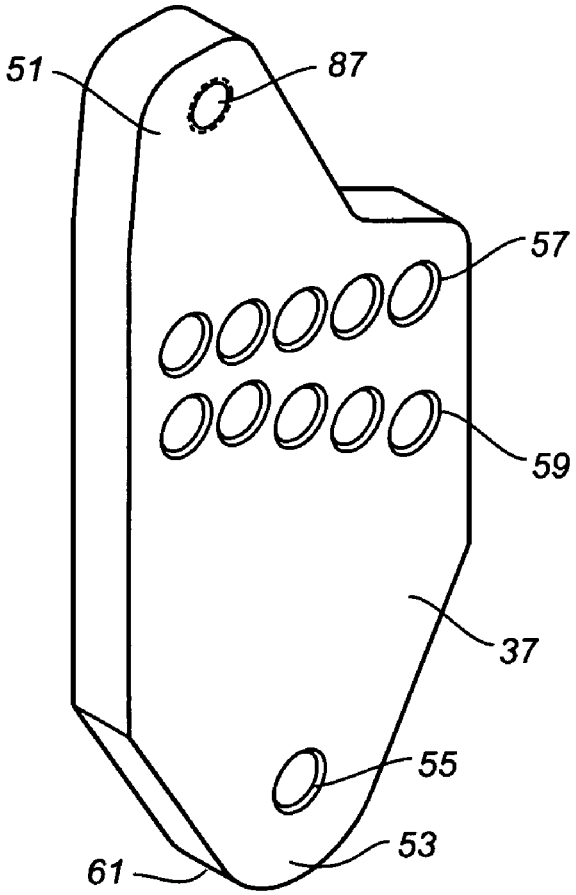
FIG. 7 is a perspective view of the splay adjustment link of the rigging frame of the invention.

FIGS. 3, 3A, 3B, 4 and 4A further illustrate adjusted positions of the connecting link 35, 37 in their respective guide channels. The front plate 25 of the assembled side frame structure 10 is removed in FIGS. 3A, 3B and 4A for illustrative purposes. FIGS. 6 and 7 illustrate in greater detail the connecting links of the side frame structure.

First, it will be appreciated that a loudspeaker rigging system employing rigging side frames in accordance with the invention will have two frames (a left and right side frame) for each loudspeaker to be rigged in a loudspeaker stack. Each side frame will nominally have one associated splay adjustment link 37 and one associated pivot link 39, which can be stowed in and deployed from the frame. Each rigging side frame will also be capable of receiving an adjustment link and pivot link associated with a side frame of a vertically adjacent loudspeaker within a stack of loudspeakers. The splay adjustment link associated with each side frame structure is seen to include a top extended end 51 having a threaded hole 87 for receiving the gripping knob 34 as hereinafter described, a base end 53, a base end locking pin hole 55, and an array of two rows of adjustment locking pin holes, namely top row 57 and bottom row 59. The base end of the adjustment link has a rounded bottom seating edge 61 that corresponds to the rounded bottom seating surface 63 of adjustment link guide channel 19*a* in the top corner regions 16, 18 of the frame structure (see FIG. 3B). The guide channel 19*a* is formed between side plates 25, 27 by the cutout 19 in the frame assembly's center core section 15. Pin holes 65 in the front and back side plates 25, 27 are located centrally of the cutout 19 such that, when the base end of splay adjustment link associated with a vertically adjacent side frame seats within and is cradled by the curved bottom of the channel formed by the cutout as shown in FIG. 3B, the pin hole 55 of the link and the pin holes 65 of the frame side plates align. This self-alignment facilitates the pinning of the splay adjustment link to the top corner region of the side frame when assembling the loudspeaker rigging.

With further reference to FIG. 3B, the pivot link 39*a* associated with a vertically adjacent rigging side frame is shown. It similarly has a base end 69 and a top extended end 71. The rounded bottom seating edge 73 of this link's base end 69 conforms to the rounded seating surface 75 of cutout 21, such that, when the base end of the pivot link seats within the guide channel 21*a* formed by cutout 21 and side plates 25, 27, the locking pin hole 77 in the base of the pivot link aligns with the locking pin holes 67 in the side plates of the frame assembly. Thus, the pivot link is also self-aligning when it is dropped into the guide channel of the side frame assembly.

A splay adjustment link stow channel 33*a* and a pivot link stow channel 35*a* are provided in the bottom corner regions 20, 22 of frame structure 12 vertically opposite the frame structure's top guide channels 19*a*, 21*a*. As above-mentioned, these stow channels are formed by the open regions 33, 35 in the frame assembly's center core 13, which are bounded by the assembly's side plates 25, 27. The row of frame pin holes 60 and the pin hole 62 allow the splay adjustment link and pivot link to be operatively pinned in a stowed or deployed position; the row of pin holes 60 for the splay adjustment link further allow for fine adjustments of splay angles between adjacent rigging frames.

Figure 3A:
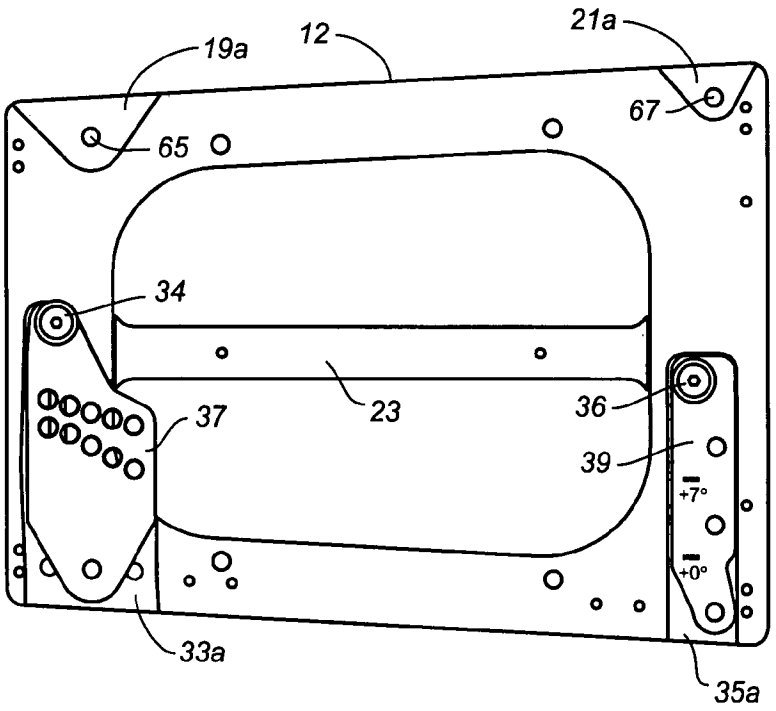
FIG. 3A is a front elevational view of the frame assembly as shown in FIG. 3 with the front side plate removed to reveal the guide channels and stow channels of the side frame structure and how the splay adjustment link and pivot link stow away within their respective channels.
Figure 3:
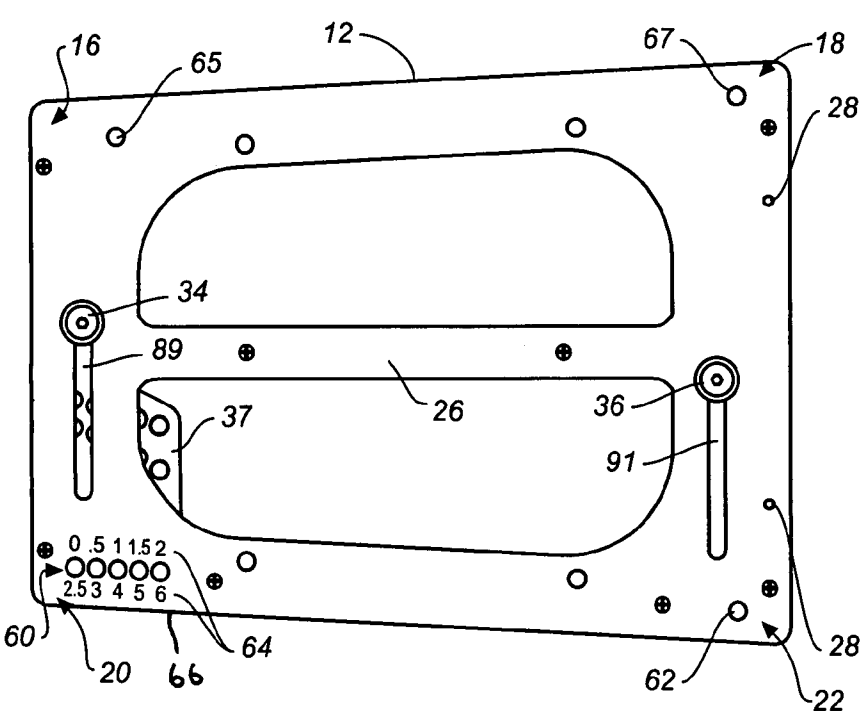
FIG. 3 is a front elevational view of the assembled frame assembly shown in FIG. 1A
Figure 3B:
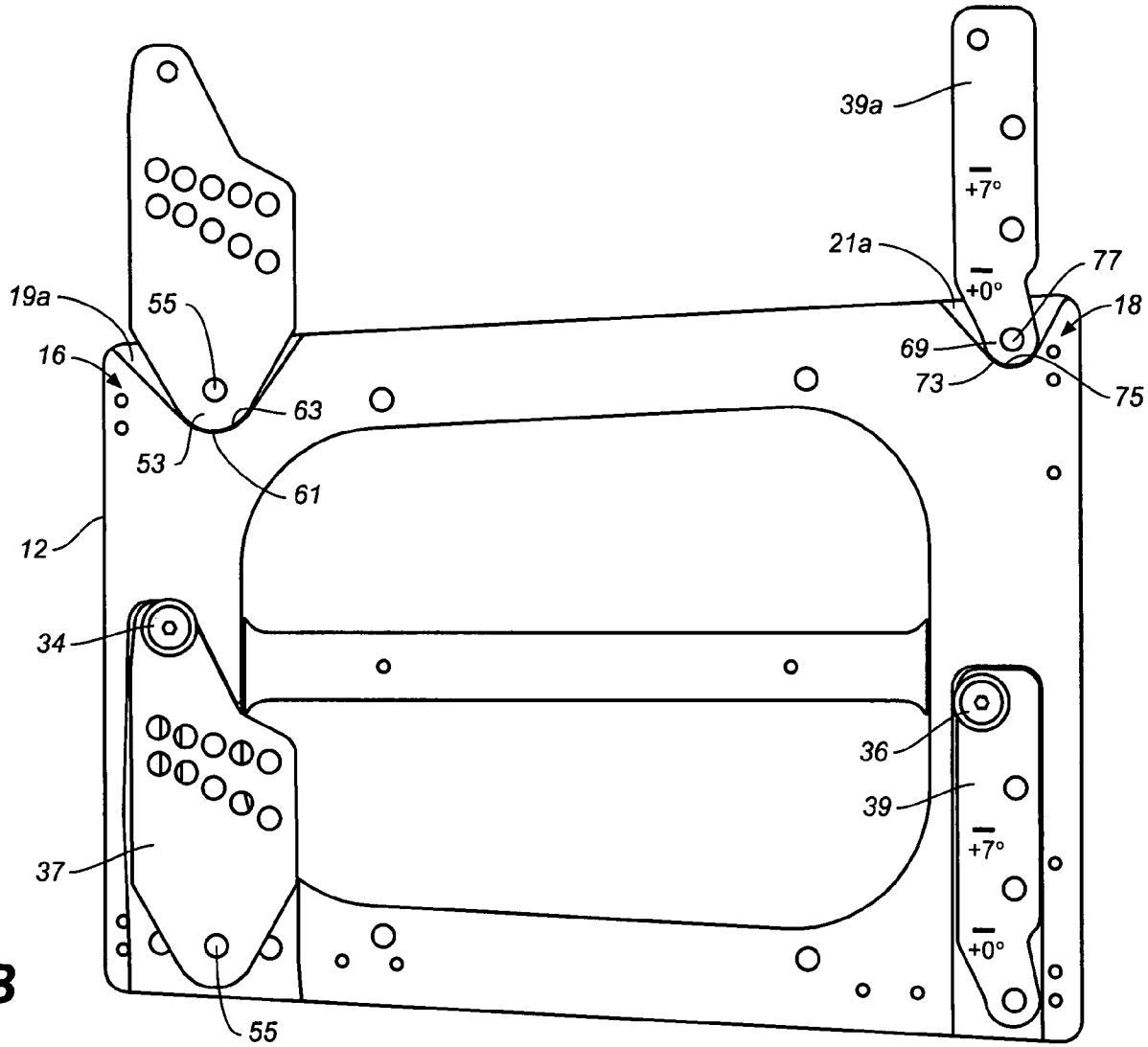
FIG. 3B is a front elevational view of the frame assembly as shown in FIG. 3 with the front side plate removed to reveal the guide channels and stow channels of the side frame structure and how the base of the splay adjustment link and pivot link cradle within their respective cradling surfaces of the link guide channels for the rigging frames of the sub-adjacent loudspeakers.
Figure 5:
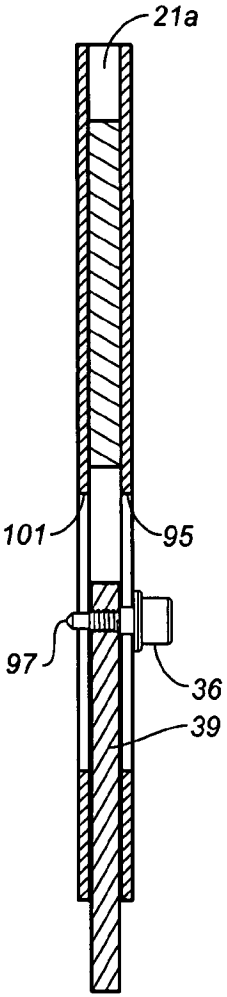
FIG. 5 is a cross-sectional view thereof taken along lines 5-5 in FIG. 4.

To interconnect the rigging side frames of two adjacent loudspeakers in a stack of loudspeakers, the pivot link 39 is first released from its stowed position shown in FIGS. 3 and 3A by removing the locking pin 45 (shown in FIG. 2) holding it in its stowed position. The pivot pin is seen to have two positioning pin holes, a first positioning pin hole 89 for establishing a relatively short extension of the pivot link that corresponds to a zero splay modifying angle at this corner of the frame, and a second pin hole 91 for establishing a relatively long extension of the pivot link that corresponds to a splay modifying angle at this corner, e.g. a seven degree angle, that might be desired in certain applications, for example, under-balcony applications. Once the pivot link is released, the rigger can use the gripping knob 36 attached to the pivot link to move the link down in the pivot link stow channel 35*a* until the desired positioning pin hole 89, 91 of the link registers with frame pin hole 62. The locking pin 45 is then reinserted into these registered holes to pin the pivot link in its extended position. After that the base end 69 of the pivot link is dropped down into a pivot link guide channel 21*a* of an adjacent frame until it seats in the bottom of the guide channel, whereupon it is pinned to the adjacent frame by using locking pin 42 of the adjacent frame.

After the pivot link is connected, locking pin 44 is removed from the stowed splay adjustment link adjustment 37 and the adjustment link is moved vertically down out of its stowed position by holding and moving gripping knob 34 in the direction of the slot 93 in the frame's front plate 25. A splay angle is selected by moving the link until a selected one of the splay adjustment pin holes of the rows 57, 59 of pin holes in the extended end of the adjustment link is matched with a corresponding one of the holes in the row of adjustment pin holes 60 in the frame's bottom corner region 20. The selected adjustment pin hole will determine the degree of drop of the adjustment link and hence the splay angle. As shown in FIG. 3, angle indications 64 are suitably provided on the frame above and below the row of pin holes 60 to assist the user in selecting a desired angle. (The top row of angle indications corresponds with the top row of pin holes 57 in the splay adjustment link, and the bottom row of angle indications corresponds with the bottom row of pin holes 59 in the splay adjustment link.) In the illustrated embodiment, the splay adjustment link is designed to permit splay adjustments of zero degrees to 3 degrees in 0.5 degree increments, and then 3 to 6 degrees in one degree increments. This requires ten pin holes as shown at set locations on the link which produce the desired angle. It will be appreciated that the splay adjustment link can be provided with more or fewer pin holes for different possible splay adjustments in different increments.

Figure 4:
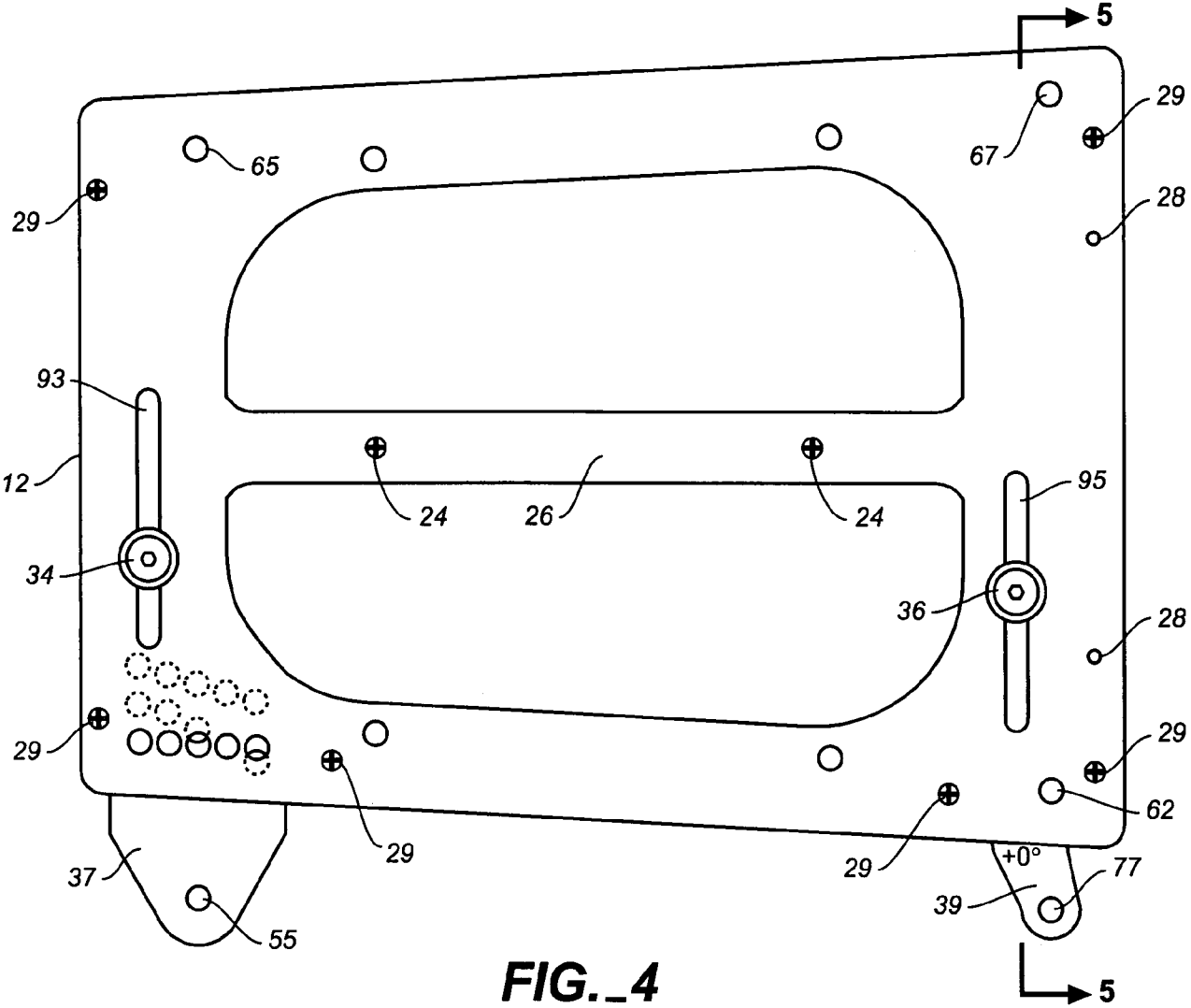
FIG. 4 is a front elevational view of a side frame assembly in accordance with the invention showing the adjustment link and pivot link extended from the stow channels of the side frame assembly.
Figure 4A:
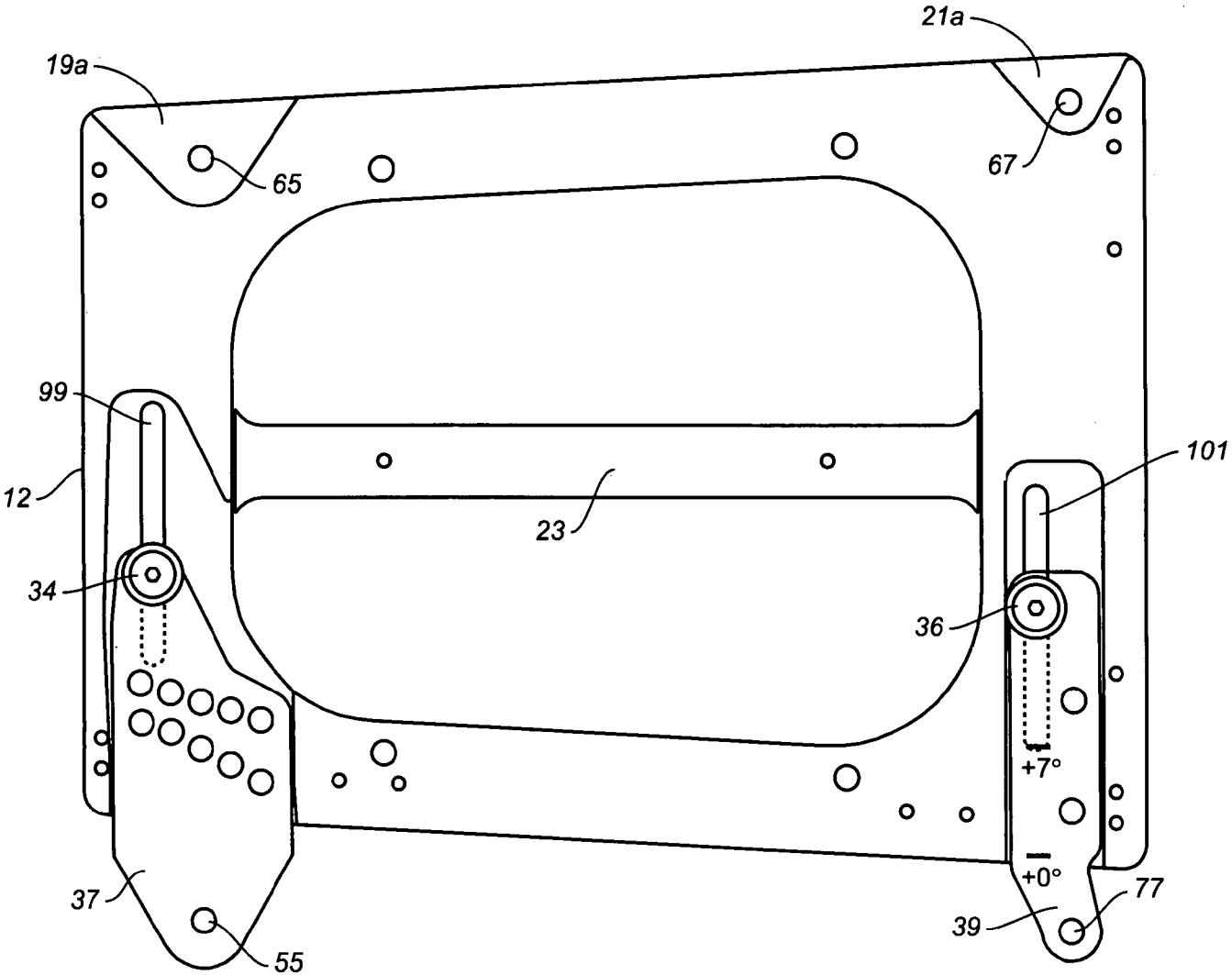
FIG. 4A is a front elevational view of the frame assembly as shown in FIG. 4 with the front side plate removed to reveal the guide channels and stow channels of the side frame structure and the splay adjustment link and pivot link extending from their respective channels.

Once a selected one of the splay adjustment pin holes on the splay adjustment link is matched with the corresponding pin hole in the frame's row of pin holes 60 as shown in FIG. 4, the adjustment link is pinned in place by the locking pin 44 (shown in FIG. 2) to lock the link into a position. In the position shown in FIG. 4, the second from the left pin hole in the second row of pin holes 59 of the splay adjustment link matches up with the second from the left pin hole of the row of pin holes 60 in the frame's bottom left corner region 20. Using the adjustment link 37 shown in FIG. 6, this pinning of the link produces a splay angle of five degrees as indicated by the bottom row of splay angle indications shown on FIG. 3.

In the locked position shown in FIG. 4, the base end of the splay adjustment link is lowered into the adjustment link guide channel 19*a* on top of the side frame of the underneath adjacent loudspeaker until the bottom edge 61 of the link seats in the guide channel so as to align pin hole 55 in the base end of the link with pin holes 65 in the frame's side plates 25, 27. With the pin holes aligned the splay adjustment link is then pinned into place on the vertically adjacent frame using a locking pin 43.

Preferably, the adjustment and pivot links 37, 39 are fabricated of carbon steel along with the outer side plates 25, 27 of the frame assembly, while center core structure 13 of the frame assembly is fabricated of a softer material such as aluminum or a plastic material such as Delrin™ or polyethylene. When rigging loudspeakers, the softer core material will yield to the steel links, which carry the weight of the loudspeakers. The softer core material will also help direct the nose of the link into the guide channels for alignment with the pin holes.

Figure 8:
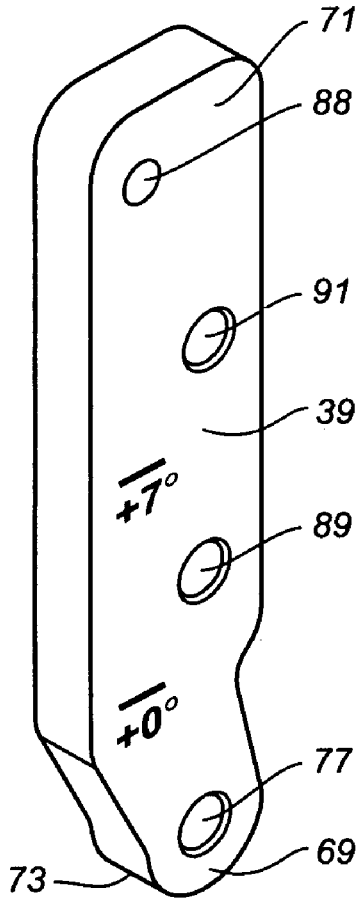
FIG. 8 is a perspective view of the pivot link of the rigging frame of the invention.

FIG. 6 illustrates in greater detail a suitable design for the gripping knobs 34, 36 attached to the frame's connecting links, which are shown in greater detail in FIGS. 7 and 8. Each knob has a large diameter gripping end 83 and an elongated smaller diameter attachment end 85, at least a portion of which is threaded. Threaded holes 87, 88 are provided in the connecting links into which the knobs are tightly screwed, such as by an Allen wrench which can be inserted into Allen wrench hole 86. When the knobs are screwed into the links, the knob's attachment end passes through the slots 93, 95 on the front plate of the frame structure 12. The length of the attachment end of the knob is preferably chosen such that the tip 97 of the attachment end projects through opposed slots 99, 101 in the back plate of the frame structure. This will provide the knob with added holding power in case the links are allowed to drop within the respective stow channels. The knobs 93, 95 are preferably fabricated of a high strength stainless steel. To facilitate the movement of the enlarged gripping end of the knobs over the front plate 25 and to prevent scratching of the front plate, nylon or other suitable washers (not shown) can be provided with the knobs for placement between the front plate and gripping ends.

Figure 9:
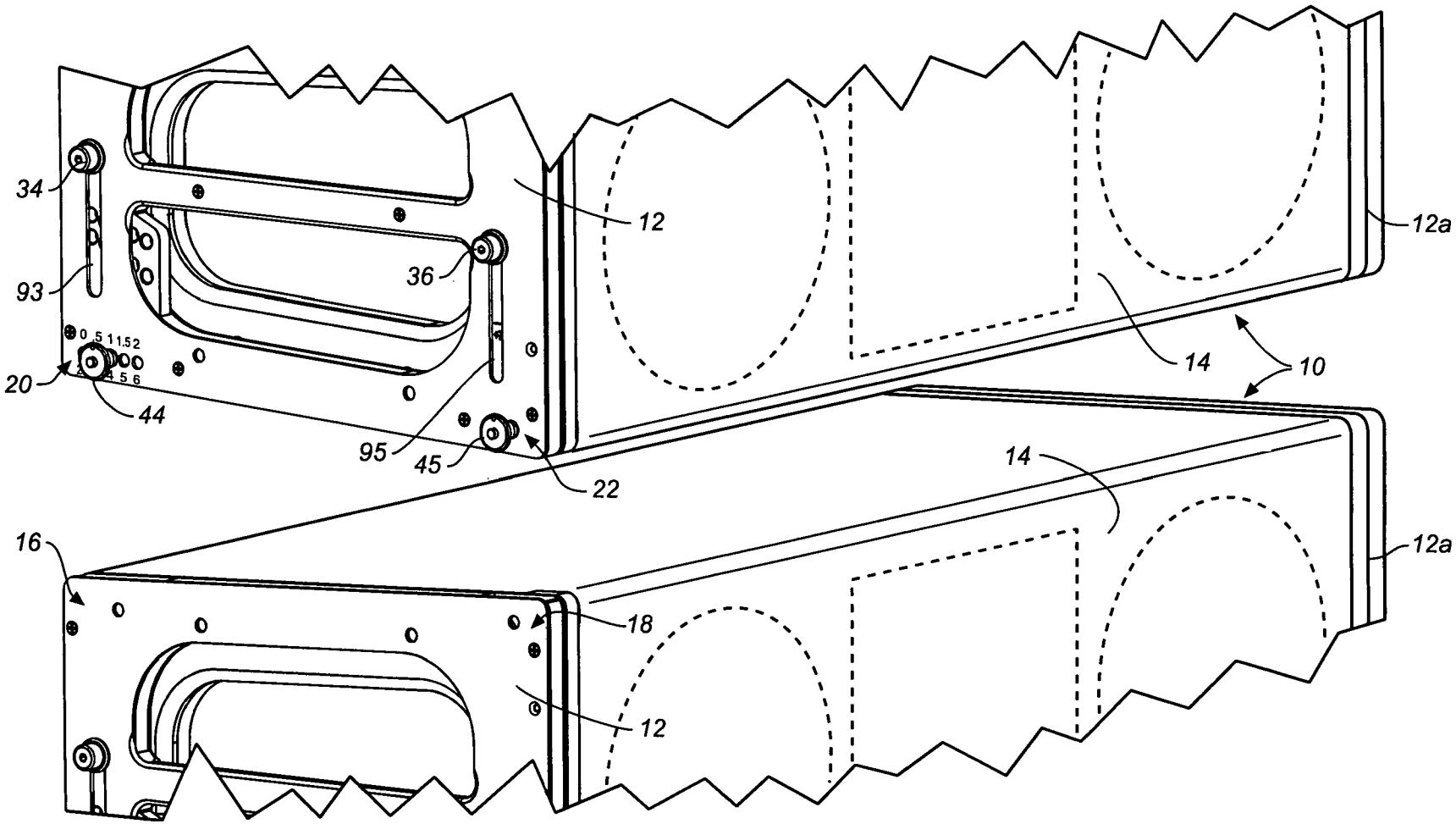
FIG. 9 is a fragmentary perspective view of a stack of loudspeakers with rigging side frames in accordance with the invention before the stowed pivot link and splay adjustment link of the rigging frame of the top loudspeaker is deployed to connect with the rigging frame of the bottom loudspeaker.
Figure 10:
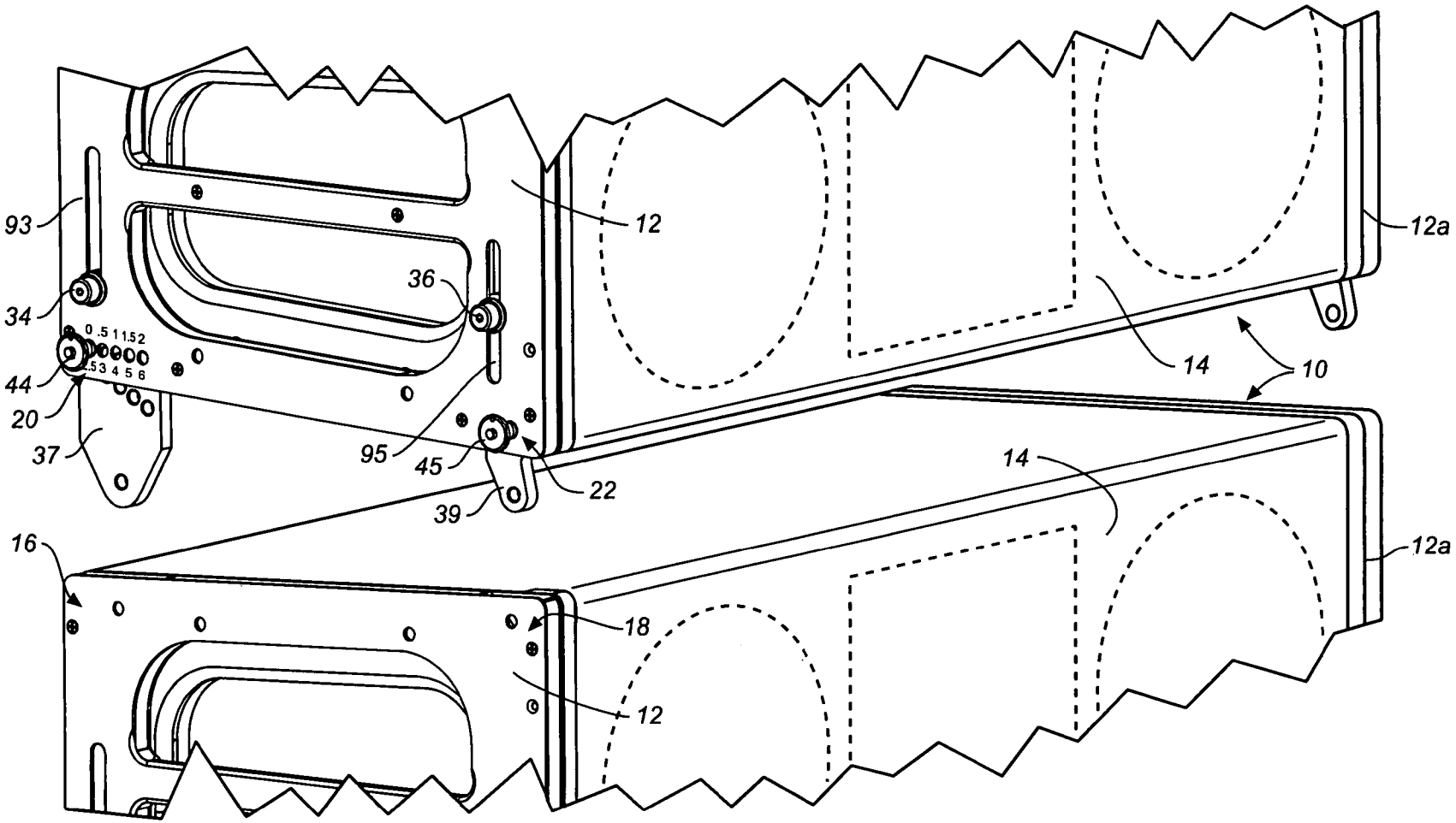
FIG. 10 is another fragmentary perspective view of a stack of loudspeakers with rigging side frames in accordance with the invention showing the pivot link and splay adjustment link of the rigging frame of the top loudspeaker deployed.
Figure 11:
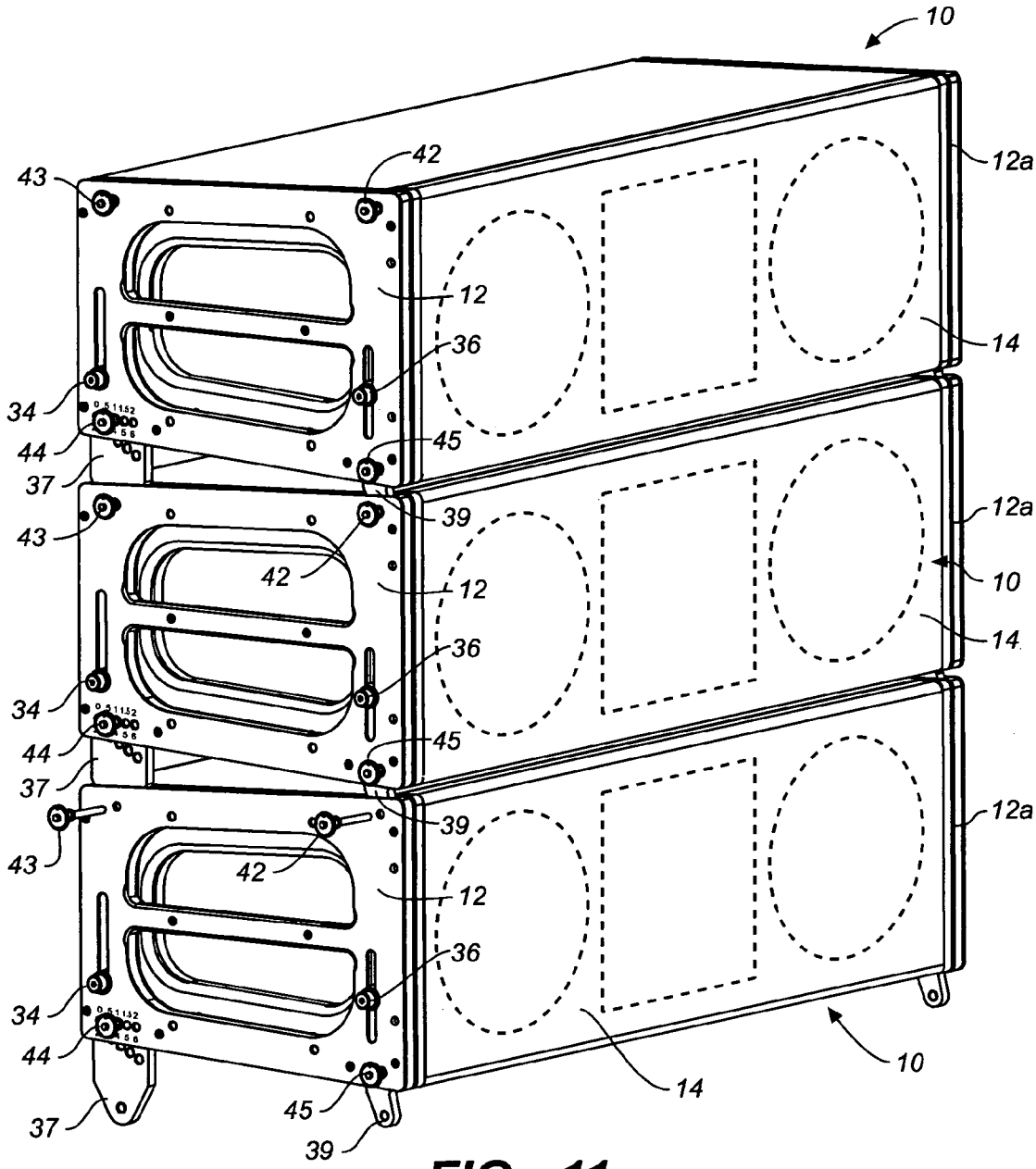
FIG. 11 is a side perspective view of a stack of three loudspeakers with rigging side frames in accordance with the invention connected together by there respective rigging frmes.

The use of the rigging side frames of the invention is further illustrated in FIGS. 9-11, wherein left and right rigging frames 12, 12*a* are shown mounted to the sides of vertically stacked loudspeakers 10 in a conventional manner, such as shown in U.S. Pat. No. 6,640,924. These figures show the front of the loudspeakers, which contain the acoustic drivers of the loudspeaker and which are usually covered by a grill 14. The front pivot links 39 are seen to link the front corners 18, 22 of the left and right rigging frames mounted to the stacked loudspeakers 10, while the splay adjustment links 37 link the frame's rear corners 16, 20. Splay angles between the stacked loudspeakers are principally achieved at the rear corners of the frames by the splay angle adjustment link as shown, with the capability of making a relatively large number of incremental splay angle adjustments as above described due to the large number of matched pin hole combinations provided by the two rows of multiple pin holes in the adjustment link. (As also above-described, the splay angle can be modified by the extension of the pivot link, such as for under balcony applications.) The four locking pins 42, 43, 44, 45 associated with each rigging frame are all the locking pins required both to deploy the splay adjustment and pivot links when rigging the loudspeakers and to stow the links when not in use.

While the most practical implementation of the invention involves providing the guide channels 19*a* and 21*a* at the top corner regions of frame structure 12 and the stow channels 33*a* and 35*a* at the bottom corner regions, reversing the channels so that the guide channels are on top and the stow channels are on the bottom of the frame is considered to be within the scope of the invention.

It is noted that added screw holes 28 can be provided at the front of the rigging side frames 12, 12*a* for grill securement screws (not shown). The grill securement screws act to secure the front grill 14 to the loudspeakers 10.

While the present invention is described in considerable detail in the foregoing specification, it is not intended that the invention be limited to such detail, except as necessitated by the following claims.

What we claim is:

1. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame structure mountable to the side of a loudspeaker, said frame having two top corner regions and two bottom corner regions, at least one pivot link and one splay adjustment link associated with said frame structure for linking the side frame of one loudspeaker to the side frame of a vertically adjacent loudspeaker, a pivot link stow channel in one of the corner regions of said frame structure for containing said pivot link and in which said pivot link can be moved from a stowed to a deployed position, a splay adjustment link stow channel in another corner region of said frame structure for containing said pivot link and in which said pivot link can be moved from a stowed to a deployed position, and a hand accessible gripping structure associated with at least one of said pivot and splay adjustment links which can be gripped to readily move by hand the at least one pivot and splay adjustment links between the stowed and deployed positions, wherein said frame structure includes at least one guide slot adjacent at least one of said stow channels for said pivot link and splay adjustment link, and said gripping structure engages said guide slot for sliding the link in the adjacent stow channel along the length of the channel.

2. The rigging side frame of claim 1 wherein the hand accessible gripping structure is provided for each of said pivot and splay adjustment links.

3. The rigging side frame of claim 1 wherein said pivot link stow channel and said splay adjustment link stow channel are provided in the bottom corner regions of said frame structure.

4. The rigging side frame of claim 1 wherein said frame structure said includes opposed guide slots adjacent at least one of said stow channels for said pivot link and splay adjustment link, and wherein said gripping structure engages both of said guide slots for sliding the link in the adjacent stow channel along the length of the channel.

5. The rigging side frame of claim 1 wherein said hand accessible gripping structure includes gripping knob on the outside of said frame structure.

6. The rigging side frame of claim 1 wherein said hand accessible gripping structure includes a gripping knob on the outside of said frame structure and an attachment end for attaching the gripping structure to the at least one pivot link and splay adjustment link.

7. The rigging side frame of claim 6 wherein said frame structure includes opposed guide slots adjacent at least one of said stow channels for said pivot link and splay adjustment link, wherein the attachment end of said gripping structure extends through said at least one pivot link and splay adjustment link and engages in both of said guide slots.

8. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame structure mountable to the side of a loudspeaker, said frame having two top corner regions and two bottom corner regions, a pivot link and a splay adjustment link associated with said frame structure for linking the side frame of one loudspeaker to the side frame of a vertically adjacent loudspeaker, said pivot link having a base end and a top extended end and at least one pin hole in said base end and at least one pin hole in said extended end, and said splay adjustment link having a base end and a top extended end and at least one pin hole in said base end and at least two pin holes in said extended end, a pivot link stow channel in one of the bottom corner regions of said frame structure for containing said pivot link and in which said pivot link can be moved between a raised stowed position and a lowered deployed position, said side frame having at least one pivot link pin hole in the bottom corner region of said side frame containing said pivot link stow channel, said pivot link pin hole being located such that it aligns with the pin hole in the extended end of said pivot link when the pivot link is in a deployed position allowing the pivot link to be pinned in place at its deployed position, and such that it aligns with the pin hole in the base end of said pivot link when the pivot link is in a stowed position allowing the pivot link to be pinned in place at its stowed position, a splay adjustment link stow channel in the other bottom corner region of said frame structure for containing said pivot link and in which said pivot link can be moved from a raised stowed to a lowered deployed position, said side frame having at least two splay adjustment pin holes in the bottom corner region of said side frame containing said splay adjustment link, each of said splay adjustment pin holes aligning with at least one of the pin holes in said splay adjustment link at different deployed positions of said splay adjustment link allowing the splay adjustment link to be pinned in place at such different deployed positions, and one of said splay adjustment link pin holes aligning with the pin hole in the base end of said splay adjustment link when the pivot link is in a stowed position allowing the splay adjustment link to be pinned in place at its stowed position a pivot link receiving channel in the top corner region of said frame structure opposite said pivot link stow channel, said pivot link receiving channel having associated pin holes and being formed to receive the base end of the pivot link of a vertically adjacent side frame so that the pin hole in the base end of the received pivot link aligns with the pin holes of said pivot link receiving channel when the base end of said link drops into said guide channel allowing the base end of a pivot link of an adjacent side frame to be pinned in place to a top corner region of said side frame structure, a splay adjustment link receiving channel in the other top corner region of said frame structure opposite said splay adjustment link stow channel, said splay adjustment link receiving channel having associated pin holes and being formed to receive the base end of the splay adjustment link of a vertically adjacent side frame so that the pin hole in the base end of the received splay adjustment link aligns with the pin holes of said splay adjustment link receiving channel when the base end of said link drops into said channel allowing the base end of a splay adjustment link of an adjacent side frame to be pinned in place to the other top corner region of said side frame structure, a hand accessible gripping structure associated with at least one of said pivot and splay adjustment links which can be gripped to readily move by hand the at least one pivot and splay adjustment links between its pinned stowed and deployed positions.

9. The rigging side frame of claim 8 wherein a hand accessible gripping structure is provided for each of said pivot and splay adjustment links.

10. The rigging side frame of claim 8 wherein said pivot link has at least two vertically displaced pin holes in its extended end for allowing the pivot link to be pinned in place at two different deployed positions.

11. The rigging side frame of claim 8 wherein the extended end of said splay adjustment link has multiple pin holes at different incremental distances from the pin hole in the base end of the splay adjustment link, and wherein said side frame has multiple splay adjustment pin holes in the bottom corner region of said side frame containing said splay adjustment link, each of which aligns with at least one of the multiple pin holes in said splay adjustment link at different deployed positions of said splay adjustment link allowing the splay adjustment link to be pinned in place at multiple different deployed positions.

12. The rigging side frame of claim 11 wherein the multiple splay adjustment pin holes in the bottom corner region of said frame structure containing said splay adjustment link are arranged in a row of pin holes near the bottom edge of the frame structure, and the multiple pin holes in the extended end of the splay adjustment link are arranged in at least one row of pin holes, each of the pin holes in the extended end of said splay adjustment link being alignable with one of the pin holes in the row of pin holes in the bottom corner region of said frame structure at different deployed positions of the splay adjustment link allowing the splat adjustment link to be pinned in place at different deployed positions.

13. The rigging side frame of claim 12 wherein at least two rows of pin holes are provided in the extended end of said splay adjustment link, each of the pin holes in said two rows of pin holes being located at different incremental distances from the pin hole in the base end of the splay adjustment link and being alignable with one of the pin holes in the row of pin holes in the bottom corner region of said frame structure at different deployed positions of the splay adjustment link.

14. The rigging side frame of claim 8 wherein said hand accessible gripping structure includes a gripping knob on the outside of said frame structure and an attachment end for attaching the gripping structure to at least one of said pivot and splay adjustment links.

15. The rigging side frame of claim 14 wherein at least a portion of the attachment end of said gripping structure is threaded and at least one of said pivot and splay adjustment links has a correspondingly threaded attachment hole into which the attachment end of said gripping structure can be screwed.

16. The rigging side frame of claim 14 wherein said gripping structure is attached to at least one of said pivot and splay adjustment links above the pin holes in the extended end of the link.

17. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame structure mountable to the side of a loudspeaker, said frame having two top corner regions and two bottom corner regions and being formed by center core and opposed front and back side plates attached to said center core, at least one pivot link and one splay adjustment link associated with said frame structure for linking the side frame of one loudspeaker to the side frame of a vertically adjacent loudspeaker, a pivot link stow channel in one of the bottom corner regions of said frame structure for containing said pivot link and in which said pivot link can be moved from a stowed to a deployed position, a splay adjustment link stow channel in the other bottom corner region of said frame structure for containing said pivot link and in which said pivot link can be moved from a stowed to a deployed position, said pivot link stow channel and splay adjustment link stow channel being formed by cut-outs in said center core and said side plates, said front side plate having a guide slot adjacent at least one of said stow channels for said pivot link and splay adjustment link, a gripping structure affixed to at least one of said pivot and splay adjustment links and extending through said guide slot so as to be hand accessible, whereby the gripping structure can be gripped to readily move by hand the at least one of said pivot and splay adjustment links between the stowed and deployed positions along the length of said guide slot.

18. The rigging side frame of claim 17 wherein a guide slot is provided in said back side plate opposed to the guide slot in said front side plate, and wherein the gripping structure extends through the at least one of said pivot and splay adjustment links into the guide slot in said back side plate.

19. The rigging side frame of claim 17 wherein a guide slot is provided in the front side plate adjacent each of said pivot and splay adjustment links, and wherein a hand accessible gripping structure is provided for each of said pivot and splay adjustment links which extends through each of said guide slots.

20. The rigging side frame of claim 17 said gripping structure includes an enlarged knob on the outside of said front side plate for gripping by the user.

21. The rigging side frame of claim 20 said gripping structure additionally includes an attachment end that extends through the guide slot of the front side plate for attaching to the at least one of said pivot and splay adjustment links.

* * * * *

UNITED STATES PATENT AND TRADEMARK OFFICE

CERTIFICATE OF CORRECTION

PATENT NO. : 7,693,296 B2
APPLICATION NO. : 11/400747
DATED : April 6, 2010
INVENTOR(S) : John Monitto, John McGhee and Dean Marshall It is certified that error appears in the above-identified patent and that said Letters Patent is hereby corrected as shown below:

In column 1, line 63, “problems” should read --problem--.
In column 2, line 1, “installers” should read --installer’s--.
In column 2, line 4, “links the are” should read --links that are--.
In column 2, line 22, --a-- should be inserted between “having” and “gripping.”.
In column 2, line 57, --into-- should be inserted between “link” and “its.”.
In column 3, line 2, “having” should read --has--.
In column 3, line 7, “having” should read --has--.
In column 3, line 10, “in adjacent the” should read --adjacent to the--.
In column 3, line 25, “structuress” should read --structures--.
In column 3, line 26, “an perspective” should read --a perspective--.
In column 3, line 30, “an perspective” should read --a perspective--.
In column 3, line 43, “their” should read --the--.
In column 4, line 7, “there” should read --their--.
In column 4, line 8, “frmes” should read --frames--.
In column 4, line 57, “its” should read --it is--.
In column 4, line 64, “frames” should read --frame’s--.
In column 5, line 2, “frames” should read --frame’s--.
In column 5, line 13, “riggers” should read --rigger’s--.
In column 6, line 9, “allow” should read --allows--.
In column 8, line 63, “said” should be deleted between “structure” and “includes.”.
In column 8, line 64, --a-- should be inserted between “includes” and “gripping.”.
In column 10, line 50, “splat” should read --splay--.
In column 12, line 16, “the” should be deleted between “through” and “at least.”.
In column 12, line 24, --wherein-- should be inserted between “claim 17” and “said.”.
In column 12, line 27, --wherein-- should be inserted between “claim 20” and “said.”.
In column 12, line 30, “the” should be deleted before “at least.”.

Signed and Sealed this
Seventeenth Day of May, 2011

David J. Kappos

David J. Kappos
*Director of the United States Patent and Trademark Office*